US006787503B2

(12) United States Patent
Suh

(10) Patent No.: US 6,787,503 B2
(45) Date of Patent: Sep. 7, 2004

(54) SUBLIMATION TRANSFER PAPER FOR COTTON FABRICS

(76) Inventor: Chung Kil Suh, No. 304-705, Sungwon Apartment, 193, Taejun-dong, Kwangju-shi, Kyunggi-do (KR)

( * ) Notice: Subject to any disclaimer, the term of this patent is extended or adjusted under 35 U.S.C. 154(b) by 42 days.

(21) Appl. No.: 10/349,959

(22) Filed: Jan. 24, 2003

(65) Prior Publication Data

US 2003/0139294 A1 Jul. 24, 2003

(30) Foreign Application Priority Data

Jan. 24, 2002 (KR) ..... 10-2002-0004143
Sep. 30, 2002 (KR) ..... 10-2002-0059362

(51) Int. Cl.[7] ..... B41M 5/035; B41M 5/38
(52) U.S. Cl. ..... 503/227; 8/471

(58) Field of Search ..... 8/471; 503/227

(56) References Cited

U.S. PATENT DOCUMENTS 6,261,995 B1 * 7/2001 Nakajima et al. ..... 503/227

* cited by examiner

*Primary Examiner*—Bruce H. Hess
(74) *Attorney, Agent, or Firm*—Nixon & Vanderhye P.C.

(57) ABSTRACT

The present invention is related to sublimation transfer paper for cotton fabrics comprising sheet, printing layer and mixture resin layer containing polyethylenevinyl acetate, stearic acid and wax as a lubricant. More particularly, the transfer paper of the present invention has an enriched sublimation seepage force of dyes into the cotton fabrics and an improved surface touch feeling of cotton fabrics after transfer.

14 Claims, 1 Drawing Sheet

SUBLIMATION TRANSFER PAPER FOR COTTON FABRICS

FIELD OF THE INVENTION

The present invention is related to sublimation transfer paper for cotton fabrics comprising sheet, printing layer and mixture resin layer containing polyethylenevinyl acetate, stearic acid and wax as a lubricant. More particularly, the transfer paper of the present invention has an enriched sublimation seepage force of dyes into the cotton fabrics and an improved surface touch feeling of cotton fabrics after transfer.

BACKGROUND OF THE INVENTION

Generally, transfer papers using disperse dyes are widely applied to chemical fabrics because the chemical fabrics have higher expansion and shrinkage ability of fiber texture than cotton fabrics, and because disperse dyes are excellently absorbed into the chemical fabrics. However, the chemical fabrics have poorer texture, hygroscopicity and ventilative ability than the cotton fabrics, therefore a transfer paper using disperse dyes that can be applied to cotton fabric needs to be developed.

Since cotton fabrics show a low strain intensity with expansion and shrinkage of fiber texture by heating, transcription using disperse dyes is difficult and the resulting print is not clear. Particularly, when conventional transfer paper using disperse dyes is employed, because the dyes do not permeate the cotton fabrics, printed transfer paper cannot be transcribed directly onto cotton fabrics. Thus, disperse dyes are previously transcribed on a resin layer such as polyurethane, then the transcribed polyurethane layer is adhered to the cotton fabric by using adhesives.

When a resin layer such as polyurethane is employed, the polyurethane forms a resin layer on the surface of cotton fabrics, which makes the touch feeling inferior and washing and drying difficult. Also the transfer paper is inferior in printing visibility, because the disperse dyes are not directly permeated into the cotton fabrics, but instead the transferred polyurethane layer adheres to the cotton fabrics.

FIG. 1 shows a cross section of transfer paper for cotton fabrics disclosed in Korean Patent Publication No. 1994-260. The transfer paper for cotton fabrics consists of paper (11), disperse dye printing layer(12), organic wax layer(13), polyurethane layer(14) and adhesive layer(15) from the bottom, wherein the organic wax and the polyurethane are formed on printing layer(12) in order to have the disperse dyes permeate into the cotton fabrics.

However, because the above polyurethane layer containing the disperse dyes is not completely permeated into the cotton fabrics but forms a layer on the surface of cotton fabrics by temporary adhesion, the surface of cotton fabrics becomes stark, and the touch feeling becomes inferior. In addition the temporarily adhered polyurethane layer becomes cracked when the temperature falls in winter, and the transferred section is desorbed from the surface of cotton fabrics when washing. Therefore, the above transfer paper is not suitable for common use.

SUMMARY OF THE INVENTION

The object of the present invention is to provide sublimation transfer paper for cotton fabrics comprising sheet, printing layer and resin layer containing polyethylenevinyl acetate, stearic acid and wax as a lubricant. More particularly the transfer paper of the present invention shows enriched sublimation seepage force of strain for cotton fabrics, and improved surface touch feeling of cotton fabrics when used as a transfer.

These and other features of the present invention will be well understood by one skilled in the art from the following detailed descriptions.

DETAILED EXPLANATION OF THE INVENTION

The present invention provides sublimation transfer paper for cotton fabrics comprising sheet, printing layer, and mixture resin layer containing polyethylenevinyl acetate, stearic acid and wax as a lubricant. More particularly, the transfer paper of the present invention has an enriched sublimation seepage force of dyes into the cotton fabrics and an improved surface touch feeling of cotton fabrics after transfer.

Sheet may be paper or polypropylene film.

Printing layer contains images, letters et al. that are to be printed on the cotton. The printing layer is formed on the sheet by applying disperse dyes with a gravure printing, offset printing or inkjet printing method.

Resin layer supports and transports the printing layer.

The resin layer is formed on the printing layer by applying a resin layer composition on the printing layer. Preferably, the resin layer composition may be cream state.

The resin layer composition is composed of polyethylenevinyl acetate 30~50 parts by weight, stearic acid 25~35 parts by weight and wax 25~35 parts by weight to 100 parts by weight of a solvent, dissolved in 100 parts by weight of the solvent by reacting at 80~100° C. in a heating reactor, then produced as a cream at a mixing roll. In the resin layer composition, wax is used as a lubricant.

The solvent comprises toluene, methyl ethyl ketone (MEK), ethyl acetate or the like.

The stearic acid comprises 1-heptadecanecarboxylic acid, octadecanoic acid, pearl stearic acid, stearophanic acid, stearic beads, N-octadecanoic acid, promulsin, but not limited thereto.

The resin layer is formed by applying the cream state of resin layer composition on the printing layer 1 or 2 times to finally produce sublimation transfer paper for cotton fabrics. Preferably, the resin layer composition may be applied on the printing layer by silk-screen.

The transfer paper is put on a cotton fabric and pressed at 180~200° C., 4~5 kgf/cm$^2$ for 15~20 sec., so that the disperse dyes of the printing layer can be transferred to the resin layer, then the resin layer containing disperse dyes is permeated into cotton fabrics by heating.

Figure 1:
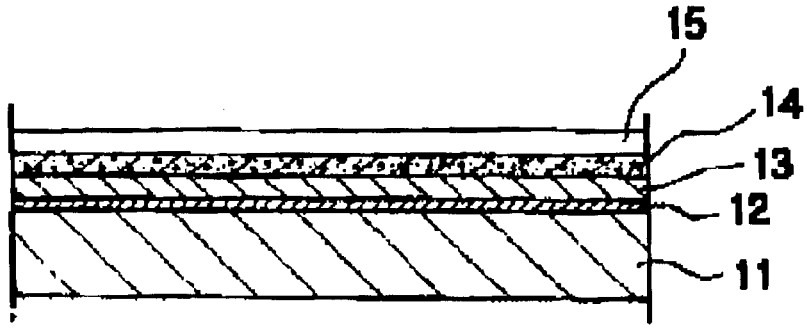
FIG. 1. shows a cross section of conventional transfer paper for cotton fabrics.
Figure 2:
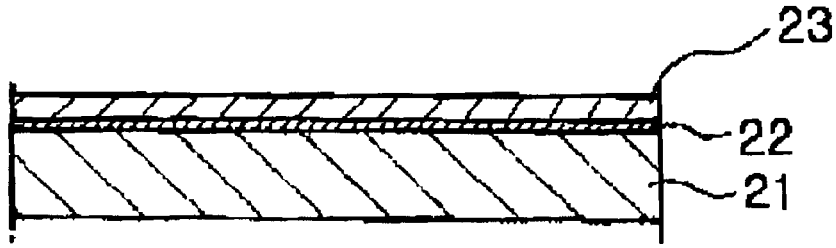
FIG. 2. shows a cross section of sublimation transfer paper for cotton fabrics according to the present invention.

FIG. 2 is a cross section of sublimation transfer paper for cotton fabrics according to the present invention and shows that the transfer paper for cotton fabrics according to the present invention comprises sheet(21), printing layer(22) and resin layer(23) from the bottom.

Figure 3:
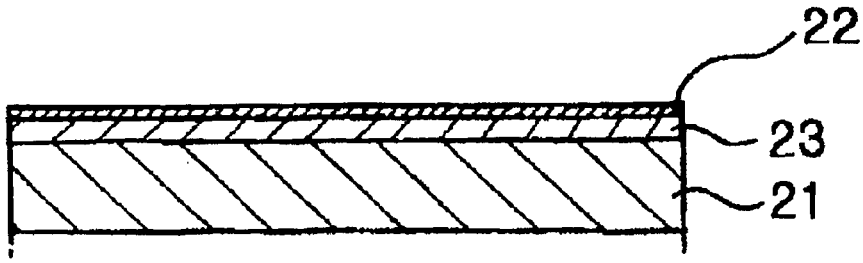
FIG. 3. shows an another cross section of sublimation transfer paper for cotton fabrics according to the present invention.

Alternatively, as FIG. 3 shows, the resin layer(23) can be formed on the sheet(21) and then the printing layer(22) formed on the resin layer(23). The transfer paper of FIG. 3 also can be pressed at 180~200° C., 4~5 kgf/cm$^2$ for 15~20 sec. to print cotton.

PREFERRED EMBODIMENT OF THE INVENTION

The present invention may be embodied by way of the following examples. However, these examples are provided for the purpose of illustration only, and should not be construed as limiting the scope of the invention, which is properly delineated in the accompanying claims.

EXAMPLE 1

The printing layer(22) was formed on a sheet(21) by applying disperse dyes on the sheet(21) by inkjet printing. The sheet(21) was paper.

Polyethylenevinyl acetate 40 g, stearic acid 30 g and wax 30 g were dissolved in 100 g of toluene while stirring, and reacted at 80° C. in a heating reactor, then stirred and mixed in a 3 bone mixing roll to give a cream state of the resin layer composition.

The resin layer(23) was formed by applying the resin layer composition on the printing layer(22) twice by silk-screen printing to produce sublimation transfer paper for cotton fabrics(FIG. 2).

EXAMPLE 2

The resin layer(23) was formed on a sheet(21) by applying the resin layer composition on the sheet(21) twice by silk-screen printing.

The resin layer composition was prepared by the method of Example 1.

The printing layer(22) was formed by applying disperse dyes on resin layer(23) by inkjet printing to produce sublimation transfer paper for cotton fabrics(FIG. 3).

Although this invention has been described with respect to specific embodiments, the details of these embodiments are not to be construed as limitations. Various equivalents, changes and modifications may be made without departing from the spirit and scope of this invention, and it is understood that such equivalent embodiments are part of this invention.

According to the present invention, when the sublimation transfer paper was transferred to cotton fabrics by printing disperse dyes, the disperse dyes were dispersed to a resin layer(23) containing polyethylenevinyl acetate and stearic acid, and then the composition of resin layer with disperse dyes was permeated to the cotton fabrics to improve surface touch feeling of the cotton fabrics. Since the sublimation transfer paper of the present invention did not form an adhesion layer on the surface of cotton fabrics as shown in the conventional art, the transferred disperse dyes were not desorbed on the surface of cotton fabrics.

As described in example 2, the transfer paper of the present invention that was formed on the printing layer before the resin layer was formed had excellent seepage force of strain by increasing the amount of ink absorbed and improving desorption for washing.

What is claimed is:

1. A sublimation transfer paper for cotton fabrics comprising sheet, printing layer and resin layer, wherein said resin layer is a composition layer comprising polyethylenevinyl acetate, stearic acid and wax.

2. The sublimation transfer paper for cotton fabrics according to claim 1, wherein the layers are laminated in order from the bottom sheet, printing layer and resin layer.

3. The sublimation transfer paper for cotton fabrics according to claim 1, wherein the layers are laminated in order from the bottom sheet, resin layer and printing layer.

4. The sublimation transfer paper for cotton fabrics according to claim 1, wherein the printing layer is prepared by using disperse dyes.

5. The sublimation transfer paper for cotton fabrics according to claim 1, wherein said polyethylenevinyl acetate, stearic acid and wax are contained in a ratio of 30~50: 25~35: 25~35 in the resin layer.

6. The sublimation transfer paper for cotton fabrics according to claim 1, wherein the composition of resin layer is a cream state prepared by dissolving said polyethylenevinyl acetate 30~50 parts by weight, said stearic acid 25~35 parts by weight and said wax 25~35 parts by weight to 100 parts by weight of a solvent in 100 parts by weight of the solvent while stirring, and reacting at 80~100° C. in a heating reactor, then mixing and stirring in a mixing roll.

7. A method for preparing sublimation transfer paper for cotton fabrics comprising the steps of:

(1) printing images or letters on a sheet to make a printing layer; and (2) applying resin layer composition on the printing layer to make a resin layer;

wherein said printing is performed by using disperse dye and said resin layer composition comprises polyethylenevinyl acetate, stearic acid and wax.

8. The method according to claim 7, wherein said polyethylenevinyl acetate, stearic acid and wax are contained in a ratio of 30~50: 25~35: 25~35 in the resin layer.

9. The method according to claim 7, wherein said resin layer composition is prepared by dissolving said polyethylenevinyl acetate 30~50 parts by weight, said stearic acid 25~35 parts by weight and said wax 25~35 parts by weight to 100 parts by weight of a solvent in 100 parts by weight of the solvent while stirring, and reacting at 80~100° C. in a heating reactor, then mixing and stirring in a mixing roll.

10. The method according to claim 9, wherein said solvent is toluene, methyl ethyl ketone or ethyl acetate.

11. A method for preparing sublimation transfer paper for cotton fabrics comprising the steps of:

(3) applying resin layer composition on a sheet to make a resin layer; and (4) printing images or letters on the resin layer to make a printing layer;

wherein said printing is performed by using disperse dye and said resin layer composition comprises polyethylenevinyl acetate, stearic acid and wax.

12. The method according to claim 11, wherein said polyethylenevinyl acetate, stearic acid and wax are contained in a ratio of 30~50: 25~35: 25~35 in the resin layer.

13. The method according to claim 11, wherein said resin layer composition is prepared by dissolving said polyethylenevinyl acetate 30~50 parts by weight, said stearic acid 25~35 parts by weight and said wax 25~35 parts by weight to 100 parts by weight of a solvent in 100 parts by weight of the solvent while stirring, and reacting at 80~100° C. in a heating reactor, then mixing and stirring in a mixing roll.

14. The method according to claim 13, wherein said solvent is toluene, methyl ethyl ketone or ethyl acetate.

* * * * *